US008251614B2

(12) United States Patent
Karstad et al.

(10) Patent No.: US 8,251,614 B2
(45) Date of Patent: Aug. 28, 2012

(54) ELECTRICAL POWER SYSTEM FOR A SUBSEA SYSTEM

(75) Inventors: Vemund Karstad, Oslo (NO); Asle Einar Skjellnes, Ranheim (DE)

(73) Assignee: Siemens Aktiengesellschaft, Munich (DE)

( * ) Notice: Subject to any disclaimer, the term of this patent is extended or adjusted under 35 U.S.C. 154(b) by 50 days.

(21) Appl. No.: 12/097,986

(22) PCT Filed: Dec. 19, 2005

(86) PCT No.: PCT/EP2005/013652

§ 371 (c)(1),
(2), (4) Date: Sep. 25, 2008

(87) PCT Pub. No.: WO2007/071266

PCT Pub. Date: Jun. 28, 2007

(65) Prior Publication Data

US 2009/0226262 A1 Sep. 10, 2009

(51) Int. Cl.
*B63C 11/00* (2006.01)

(52) U.S. Cl. ..... 405/193; 405/190

(58) Field of Classification Search ..... 405/190, 405/191, 193

See application file for complete search history.

(56) References Cited

U.S. PATENT DOCUMENTS

| | | | | |
|---|---|---|---|---|
| 3,520,358 | A * | 7/1970 | Brooks et al. | 405/191 |
| 4,010,619 | A * | 3/1977 | Hightower et al. | 405/191 |
| 4,074,516 | A | 2/1978 | Kondo | 58/38 |
| 4,309,734 | A * | 1/1982 | Warren | 361/58 |
| 4,337,829 | A | 7/1982 | Banzoli et al. | 166/366 |
| 5,088,558 | A * | 2/1992 | Mohn | 166/339 |
| 6,802,237 | B1 * | 10/2004 | Jones et al. | 89/1.13 |
| 7,576,447 | B2 | 8/2009 | Biester et al. | 307/12 |
| 2003/0034177 | A1 | 2/2003 | Chitwood et al. | 175/61 |
| 2003/0153216 | A1 | 8/2003 | Van-Drentham-Susman | 440/45 |
| 2004/0083940 | A1 | 5/2004 | Shelton et al. | 114/312 |
| 2005/0029476 | A1 | 2/2005 | Biester et al. | 251/58 |
| 2006/0196695 | A1 * | 9/2006 | Giroux et al. | 166/380 |
| 2008/0093082 | A1 * | 4/2008 | Sheshtawy | 166/368 |

FOREIGN PATENT DOCUMENTS

| | | |
|---|---|---|
| DE | 10127276 | 1/2003 |
| EP | 0028296 | 8/1980 |
| EP | 1394822 | 2/2001 |

(Continued)

OTHER PUBLICATIONS

International Search Report; PCT/EP2005/013652; pp. 2, Oct. 24, 2006.

(Continued)

*Primary Examiner* — Frederick L Lagman
(74) *Attorney, Agent, or Firm* — King & Spalding L.L.P.

(57) ABSTRACT

An electrical power system for stationary or movable subsea loads (7) provides one common feeder for multiple electric motors which can be individually controlled. Operational flexibility and operational safety for operation in varying water depths is provided by encapsulating electrical functional element (6) of a subsea power system with a subsea electrical distribution system (5) individually or in-groups. Electrical functional element (6) and their semi-conductor elements are arranged within at least one fluidized internal pressure casing (13). An external pressure casing (12) is provided for the subsea electrical distribution system (5) and/or other components of the subsea system. A high frequency power transmission to the subsea pressurized distribution system (5) with pressurized semi-conductor components reduces weight and size of subsea transformers (**4*b*) and cables (9) employed in subsea systems (10**).

21 Claims, 1 Drawing Sheet

FOREIGN PATENT DOCUMENTS

| | | | |
|---|---|---|---|
| JP | 59127531 | | 7/1984 |
| JP | 1154995 | A | 6/1989 |
| JP | 5103912 | A | 4/1990 |
| JP | 8205375 | | 8/1996 |
| JP | 2003116220 | | 4/2003 |
| JP | 2004032837 | | 1/2004 |
| WO | 9920872 | | 4/1999 |
| WO | 9963555 | | 12/1999 |
| WO | 01/09982 | | 2/2001 |
| WO | 0241336 | | 5/2002 |
| WO | 2004/008183 | | 1/2004 |
| WO | 2004/055950 | | 7/2004 |

OTHER PUBLICATIONS

Snary, P., et al., "Drive Systems for Operation on Deep-Sea ROVs", Electrical Machines and Drives Group, Department of Electronic and Electrical Engineering, University of Sheffield, 10 pages.

* cited by examiner

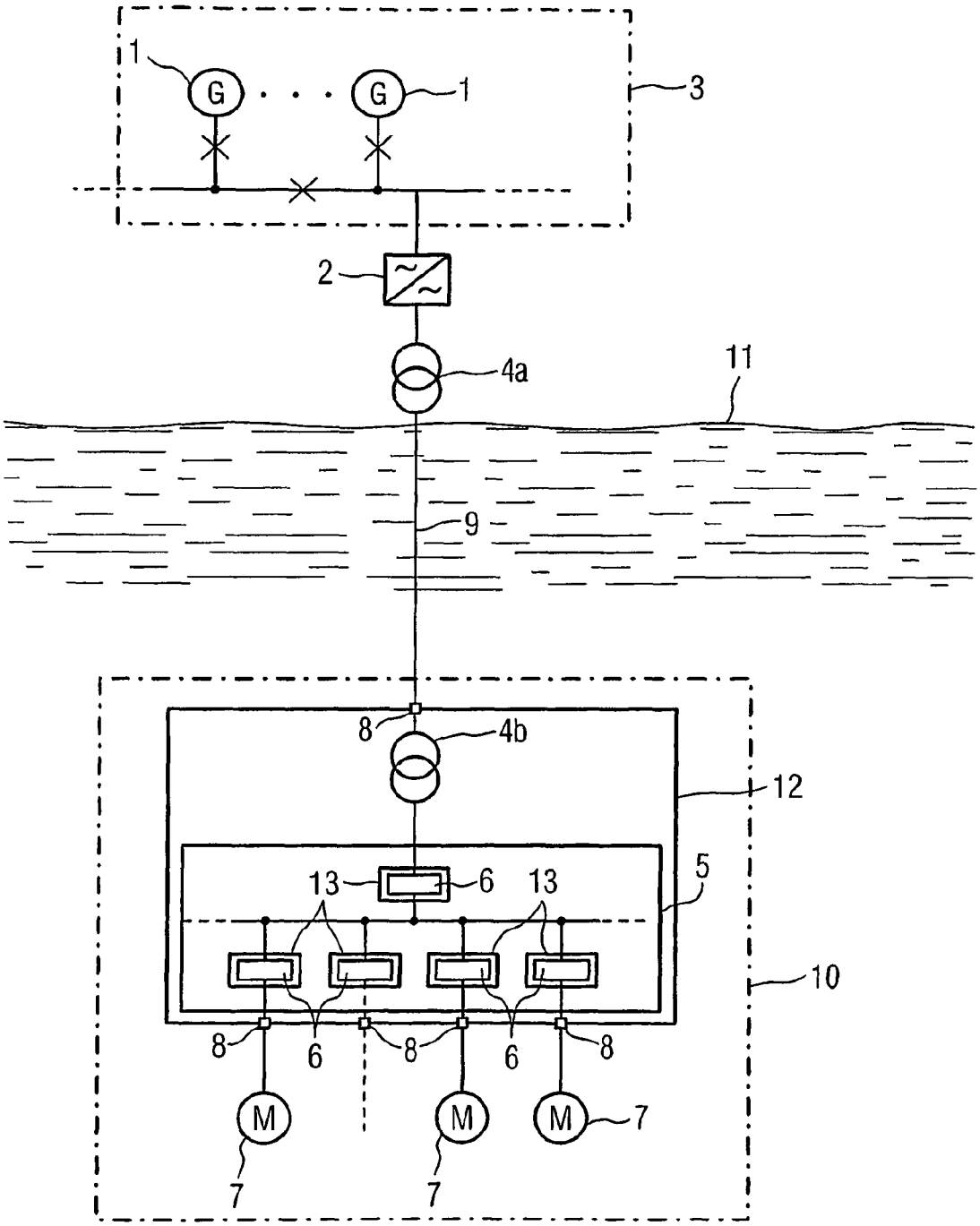
1
G
G
1
3
2
4a
11
9
8
4b
12
13
6
13
5
10
8
6
8
6
8
M
M
M
7
7
7

ELECTRICAL POWER SYSTEM FOR A SUBSEA SYSTEM

CROSS-REFERENCE TO RELATED APPLICATIONS

This application is a U.S. national stage application of International Application No. PCT/EP2005/013652 filed Dec. 19, 2005, which designates the United States of America, the contents of which are hereby incorporated by reference in their entirety.

The present invention relates to an electrical power system for a subsea system. The invention also relates to a method for operating at least one electrical load, e.g. an electrical motor, in a subsea application. Furthermore the invention also relates to a subsea remotely operated vehicle.

A subsea system may be for example a subsea oil field installation or a subsea remotely operated vehicle (ROV). Remotely operated vehicles (ROVs) are mostly unmanned and are used extensively for the inspection and maintenance of subsea oil field installations. Subsea systems may also be employed for seabed mining. Subsea installations for subsea oil field or other submarine applications, in particular applications involved with the exploration of subsea resources, may be fed by a possibly large umbilical which usually contains one or more power supply cables and at least one control cable. Subsea systems and ROVs in particular are usually powered by high voltage electricity or by hydraulic oil.

Electrical components of the subsea system have to be isolated and protected against sea water and pressure at deep sea levels. Therefore known subsea systems may comprise a vessel pressurised at 1 atmosphere. The housing of such pressurised vessels is often very heavy weight and thus limiting the manoeuvrability of the subsea system. Reducing the weight of the housing in existing systems may lead to less protection and increased likelihood of damages. Such risks increase when the subsea system is operating in deep waters or at altering depths.

It is an object of the present invention to provide an electrical power system for a subsea system which avoids or reduces the disadvantages of the prior art and increases the manoeuvrability and operational flexibility of a subsea system with an electrical power system.

According to the present invention this is achieved by an electrical power system for a subsea system comprising at least one subsea power distribution system receiving power from a power source, said subsea power distribution system comprising at least one electrical functional component, and at least one connecting member for at least one electrical load, e.g. a propulsion system or a motor for subsea operation, wherein an external pressurised casing is provided for the subsea power distribution system, and wherein at least one internal pressurised casing is provided for the at least one electrical functional component. This arrangement increases the ease of handling, enables a low weight design of the subsea system and facilitates a higher degree of standardisation of the modules of the subsea system and of the electrical power system. According to the invention two-stage pressure compensation is possible.

Advantageously the subsea power distribution system may comprise a plurality of electrical functional components and at least one internal pressurised casing may be provided for pressurising at least one electrical functional component or at least one of its parts.

Advantageously the at least one internal pressurised casing may be fluidised.

In order to provide further protection for the electrical functional components the at least one internal pressurised casing may be at least partly filled with a liquid.

In order to minimize thermal losses and at the same time provide efficient pressure compensation the at least one internal pressurised casing may be at least partly filled with oil or a liquid substance with oil as one of its components.

Advantageously the external pressurised casing may be at least partly filled with a gas or a mixture of gases. This may be particularly favourable for shallow water use.

Advantageously the external pressurised casing may be at least partly filled with nitrogen.

The internal pressurised casing of the electrical functional components results as especially advantageous if at least on electrical functional component comprises semi-conductor elements.

Advantageously at least one electrical functional component comprising semi-conductor elements may be a cycloconverter.

Advantageously at least one semi-conductor element may be a thyristor.

Advantageously one electrical functional component comprising semi-conductor elements, said electrical functional component being arranged within an internal pressurised casing, may be provided for each connecting member of the subsea system.

Advantageously at least one electrical functional component comprising semi-conductor elements, said electrical functional component being arranged within an internal pressurised casing may be provided for connection to the power source.

Advantageously at least one connecting member for at least one electrical load may be a subsea plug.

Advantageously the subsea power distribution system may be static.

Advantageously the electrical power system may comprise a subsea electrical power system according to the invention or according to one or more of its embodiments, at least one topside converter providing an output frequency of at least 100 Hz to be transmitted to the subsea system and at least one cable for power transmission to the subsea system, said cable being connected to the topside converter and said cable being connected to the subsea system. By using high frequency power transmission to the subsea system, weight and inductance of the power transmission cable may be significantly reduced. Furthermore the space consumption and weight of the electrical equipment used within subsea may also be reduced, in particular the use of more light weighted and smaller transformers is enabled. Manoeuvrability and operational flexibility of the subsea system may be increased by using high frequency power transmission.

Advantageously the output frequency of the converter may be at least 200 Hz.

Advantageously the output frequency of the converter may be at least 300 Hz.

Advantageously the output frequency of the converter may be at least 380 Hz.

The present invention also provides a method for operating at least one electrical load in a subsea application using an electrical power system according to the invention or according to one of its embodiments for power transmission to a subsea power distribution system.

The present invention also provides a subsea remotely operated vehicle (ROV) with an electrical power system according to the invention or according to one or more of its embodiments with at least one electrical load being a propulsion system for the subsea remotely operated vehicle, said propulsion system receiving power from the subsea power distribution system.

Further preferred features, details and advantages of the invention will now be described by way of example with reference to the accompanying drawing, in which:

FIG. 1 is a schematic view of an electrical power system for a subsea system.

FIG. 1 shows in schematical view an electrical power system for a subsea system 10. The subsea system itself is shown in an abstract, schematical view. This view is focused on the overall electrical design and is not intended to be comprehensive.

The subsea system 10 may be a remote operated vehicle (ROV) for subsea operation. Such ROVs are usually unmanned and may be built capable to operate in shallow and in deep water with water depths deeper than 1000 meter and up to 3000 meter, 5000 meter and more. The subsea system 10 comprises or may be connected to at least one electrical load 7. In the example shown the electrical loads 7 are electrical motors. Such electrical motors may be used for propulsion of the subsea system and/or for manipulators and/or controllers for subsea applications.

The electrical power system of the subsea system 10 comprises a power distribution system 5. The subsea power distribution system 5 comprises electrical functional elements 6, preferably at the input side and/or at the output side of the power distribution system 5. In order to provide a connection, which is safe in operation under submarine conditions, subsea plugs 8 are used as connecting members for connecting the electrical loads 7 to the subsea power distribution system 5 and to the electrical functional elements 6.

The subsea system 10 may be stationary or mobile. The subsea electrical power system of the subsea system 10 may be connected to electrical loads 7, which are mechanically attached to or that form at least temporarily part of the subsea system 10. The subsea electrical power system of the subsea system 10 may also be connected to electrical loads 7, which are part of other stationary or mobile subsea installations. It is possible that the electrical loads 7 may be connected and/or disconnected from the power distribution system 5. Electrical loads 7 may operate in pump systems, such as booster pumps or water injection pumps, which may be used in oil field or mining applications on the sea bed.

Power for the subsea system 10, e.g. an oil field subsea installation or a ROV, is fed from a top side power system 3 using at least one cable 9. The top side power system 3 is usually located above sea-level 11. The top side power system 3 may also be located at about sea-level 11 or at least partly below sea-level 11. The top side power system 3 may comprise a shore-sea cable, which is not specifically shown in FIG. 1, and/or one or more generators 1. The top side power system 3 may be located on a platform. The top side power system usually operates at a frequency of about 50 Hz or about 60 Hz.

In the embodiment shown by way of example, at least one converter 2 is provided between the top side power system 3 and the at least one power cable 9 for transmitting power for the subsea system 10. The converter 2 is preferably a high frequency converter which is designed to convert the lower frequency power of the power system 3 to a high frequency, for example to a frequency within the range of about 100 Hz to about 400 Hz. The cable 9 is designed for high frequency power transmission from a top side power system 3 to a subsea system 10. One or more power transmission cables 9 may be arranged in an umbilical connecting the subsea system 10 and its power distribution system 5 to a top side installation. A top side installation may be for example a platform, a vessel or a shore-sea cable. Said umbilical may also comprise one or more control cables for one or more subsea system 10 and/or connected loads 7.

At the top side of the at least one cable 9, a transformer 4*a* may be provided. At least one transformer 4*b* may also be provided at the subsea side. When high frequency power transmission to the subsea system 10 is used, the transformer 4*b*, which is comprised by the subsea system 10 may be considerably lighter than transformers that were previously being used for subsea systems 10.

Electrical functional elements 6 may be arranged between the power distribution system 5 and the connection to a power source, e.g. the top side power system 3. Electrical functional elements 6 may also be arranged between the power distribution system 5 and electrical loads 7 for subsea operation. Subsea plugs 8 may be used as part of connecting members. Electrical functional elements 6 may operate for example as switches and/or converters. The power distribution system 5 is preferably a static power distribution system without moving parts.

Preferably the electrical functional elements 6 comprise semi-conductor elements, which may operate as breaker, soft-start control and/or frequency control for a subsea process load 7, i.e. an electrical consumer, e.g. an electrical motor.

The electrical functional elements 6 are pressure compensated by the use of an internal pressurised casing 13. Other parts of the subsea power distribution system 5 and/or the subsea system are pressurised using an external pressurised casing 12. Preferably for each electrical functional element 6, a group of electrical functional elements 6, or at least for the semi-conductors comprised by an electrical functional element 6 an individual internal pressurized casing 13 is provided.

An electrical functional element 6 and/or its semi-conductor components are enclosed in a liquid within an internal pressurised casing 13. Preferably said liquid consists at least in part of oil. The external pressurised casing 12 is preferably filled at least partly with a gas or a mixture of gases, e.g. nitrogen. In this way a two-stage pressure system for the subsea electrical power system of the subsea system 10 may be provided.

A subsea power distribution system 5 is provided with electrical functional elements 6, which operate as multi functional, reliable controllers for electrical power loads 7 to be installed at various water depths from shallow to ultra deep water. The external pressurised casing 12 may be designed as a canister having at least in part a primarily cylindrical form.

The electrical functional elements 6 comprising semi-conductor elements may provide direct online start, soft start, i.e. low torque start, and variable frequency control for multiple electrical loads 7. Reversing of the motors may be included in the control. An electrical functional element 6 may also operate as direct driver.

An electrical functional element 6 may comprise a cycloconverter connection, preferably with branch fuses, or a star connection, which may be fuseless. It is of advantage for subsea applications if the number of cables per phase leading to an electrical load 7 is limited. One or more electrical components 6 can be installed inside one internal pressurised casing 13, e.g. for providing the functionality of a cycloconverter.

An electrical functional element 6 may comprise at least one, preferably a plurality of thyristors as semi-conductor elements, in particular when designed as a static switching element. One or more thyristors may be used in a breaker, a soft-starter and/or a cycloconverter.

The subsea electrical power system provides preferably an output range from about 3 MVA to about 30 MVA. Electrical functional elements 6 may be arranged in open or in star connection. The supply voltage of the subsea electrical power system may be for example of about 1180V, controlled and with isolated motor phases. If designed for a high number of electrical loads 7, which may be arranged in serial, a higher supply voltage may be preferred. A high short-time overload capability, e.g. 200% for 60 seconds, is provided.

The range of a movable subsea system 10 may be narrower when using high frequency power transmission but its operational flexibility is augmented due to lighter and more simple construction and design.

A primary aspect of the invention may be summarized as follows:

The invention relates to an electrical power system for stationary or movable subsea loads 7 providing one common feeder for multiple electric motors which can be individually controlled. A higher operational flexibility and increased operational safety for operation in varying water depths is provided by encapsulating electrical functional elements 6 of a subsea power system with a subsea electrical distribution system 5 individually or in groups. Electrical functional elements 6 and their semi-conductor elements are arranged within at least one fluidised internal pressure casing 13. Additionally an external pressure casing 12 is provided for the subsea electrical distribution system 5 and/or other components of the subsea system. In addition or alternatively to the arrangement described above, employing high frequency power transmission to the subsea pressurized distribution system 5 with pressurised semi-conductor components may enable a reduction of weight and size of subsea transformers 4*b* and cables 9 employed in subsea systems 10.

The invention claimed is:

1. Electrical power system for a subsea system comprising:

at least one subsea power distribution system receiving power from a power source, said subsea power distribution system configured to distrubute power to a plurality of electrical functional components, and at least one connecting member for at least one electrical load for subsea operation, wherein a first pressurized casing is provided for the subsea power distribution system, wherein at least one second pressurized casing is provided for the electrical functional components, wherein the external pressurized casing is at least partially filled with a first non-air, non-seawater fluid and the at least one internal pressurized casing is at least partially filled with a second non-air, non-seawater fluid, such that the first pressurized casing and the second pressurized casing are arranged in a two-stage pressure system.

2. Electrical power system according to claim 1, wherein the at least one second pressurized casing is provided for pressurizing at least one electrical functional component or at least one of its parts.

3. Electrical power system according to claim 1, wherein the second fluid comprises a liquid.

4. Electrical power system according to claim 3, wherein the second fluid comprises oil or a liquid comprising oil.

5. Electrical power system according to claim 1, wherein the first fluid comprises a gas or a mixture of gases.

6. Electrical power system according to claim 5, wherein the first fluid comprises nitrogen.

7. Electrical power system according to claim 1, wherein at least one electrical functional component comprises semi-conductor elements.

8. Electrical power system according to claim 7, wherein at least one electrical functional component comprising semi-conductor elements is a cycloconverter.

9. Electrical power system according to claim 7, wherein at least one semi-conductor element is a thyristor.

10. Electrical power system according to claim 7, wherein one electrical functional component comprising semi-conductor elements, said electrical functional component being arranged within a particular second pressurized casing, is provided for each connecting member of the subsea system.

11. Electrical power system according to claim 7, wherein, at least one electrical functional component comprising semi-conductor elements, said electrical functional component being arranged within a particular second pressurized casing, is provided for connection to the power source.

12. Electrical power system according to claim 7, wherein the at least one connecting member for at least one electrical load is a subsea plug.

13. Electrical power system according to claim 7, wherein the subsea power distribution system is static.

14. Electrical power system according to claim 1, comprising at least one topside converter providing an output frequency of at least 100 Hz to be transmitted to the subsea system and comprising at least one cable for power transmission to the subsea system, said cable being connected to the topside converter and said cable being connected to the subsea system.

15. Electrical power system according to claim 14, wherein the output frequency of the converter is at least 200 Hz.

16. Electrical power system according to claim 14, wherein the output frequency of the converter is at least 300 Hz.

17. Electrical power system according to claim 14, wherein the output frequency of the converter is at least 380 Hz.

18. Electrical power system according to. claim 1, wherein:

the first pressurized casing encapsulates the subsea power distribution system, and the at least one second pressurized casing is encapsulated win the first pressurized casing.

19. Electrical power system according to claim 1, wherein:

the first pressurized 'casing is internally pressurized by the first. fluid and externally pressurized by seawater; and the at least one second pressurized casing is internally pressurized by the second fluid and externally pressurized by. the first fluid.

20. Method for operating a plurality of electrical functional components in a subsea application, comprising:

providing a subsea power distribution for distributing power from a power source to the plurality of electrical functional components, wherein a first pressurized casing is provided for the subsea power distribution system, wherein at least one second pressurized casing is provided for the plurality of electrical functional components, and wherein the first pressurized casing is at least partially filled with a first non-air, non-seawater fluid and the at least one second pressurized casing is at least partially filled with a second non-air, non-seawater fluid, such that the first pressurized casing and the second pressurized casing are arranged in a two-stage pressure system; and providing power to the at least one electrical functional component via the subsea power distribution system.

21. Subsea remotely operated vehicle with an electrical power system comprising at least one subsea power distribution system receiving power from a power source, and distributing the received power to a plurality of electrical functional components, and at least one connecting member for a propulsion system for the subsea remotely operated vehicle, wherein a first pressurized casing is provided for the subsea power distribution system, wherein at least one second pressurized casing, is provided for the a plurality of electrical functional components, and wherein the first pressurized casing is at least partially filled with a first non-air, non-seawater fluid and the at least one second pressurized casing is at least partially filled with a second non-air, non-seawater fluid, such that the first pressurized casing and the second pressurized casing are arranged in a two-stage pressure system.

* * * * *